US005593023A

United States Patent [19]

Kaizaki et al.

[11] Patent Number: 5,593,023

[45] Date of Patent: Jan. 14, 1997

[54] ROTATIVELY-OPERATED ELECTRONIC COMPONENT WITH PUSH SWITCH

[75] Inventors: Keiji Kaizaki, Osaka; Tamotsu Yamamoto, Ashiya; Shigeru Yokoji, Osaka; Hiroto Inoue, Kyoto; Hiroshi Matsui, Osaka, all of Japan

[73] Assignee: Matsushita Electric Industrial Co., Ltd., Osaka, Japan

[21] Appl. No.: 598,809

[22] Filed: Feb. 9, 1996

[30] Foreign Application Priority Data

Jun. 22, 1995 [JP] Japan ..... 7-155914

[51] Int. Cl.[6] ..... H01H 19/20

[52] U.S. Cl. ..... 200/570; 200/14; 200/5 R; 200/565; 200/341; 200/564

[58] Field of Search ..... 200/570, 564, 200/565, 566, 567, 568, 569, 571, 572, 336, 11 R, 14, 11 D, 116, 11 J, 11 K, 5 R, 178, 179, 329, 330, 341

[56] References Cited

U.S. PATENT DOCUMENTS

| | | | |
|---|---|---|---|
| 3,184,557 | 5/1965 | Clarey | 200/566 |
| 3,748,419 | 7/1973 | Torrey et al. | 200/570 |
| 4,227,058 | 10/1980 | Johnston et al. | 200/566 |
| 4,504,706 | 3/1985 | Watanabe et al. . | |
| 4,996,401 | 2/1991 | Park . | |
| 5,043,546 | 8/1991 | Krause . | |
| 5,063,276 | 11/1991 | Woodard . | |
| 5,145,059 | 9/1992 | Park . | |
| 5,180,050 | 1/1993 | Rada et al. . | |

*Primary Examiner*—David J. Walczak
*Attorney, Agent, or Firm*—Pollock, Vande Sande & Priddy

[57] ABSTRACT

A rotatively-operated electronic component with a push switch includes a rotatable operation knob. A rotary contact plate is connected to the operation knob for motion together with the operation knob. Resilient contact arms provided on an attachment base plate touch the rotary contact plate. The resilient contact arms and the contact plate cooperate to generate an electric signal in response to rotation of the operation knob. A drive member connected to the attachment base plate rotatably supports the rotary contact plate. The drive member is swingable relative to the attachment base plate. The drive member is allowed to swing relative to the attachment base plate by application of a force to the operation knob. A push switch portion is supported on the attachment base plate. The push switch portion is actuated in response to swing of the drive member relative to the attachment base plate by the application of the force to the operation knob.

6 Claims, 4 Drawing Sheets

ROTATIVELY-OPERATED ELECTRONIC COMPONENT WITH PUSH SWITCH

BACKGROUND OF THE INVENTION

1. Field of the Invention

This invention relates to a rotatively-operated electronic component with a push switch which is usable in various electronic devices such as a remote-controller operation unit or a portable electronic device.

2. Description of the Prior Art

It is known that a rotatively-operated electronic component and a push switch which have different knobs are separately provided in an electronic device. A typical example of the rotatively-operated electronic component is a rotary encoder having a knob which is rotatable about an axis perpendicular to a base plate of an encoder body. In the above-indicated known arrangement, the sum of the spaces occupied by the two knobs tends to be relatively large. This cause a barrier to the miniaturization of the arrangement. To operate the electronic component and the push switch, it is necessary to actuate the two knobs which is inconvenient.

SUMMARY OF THE INVENTION

It is an object of this invention to provide a small electronic component with a push switch.

It is another object of this invention to provide an easily-operated electronic component with a push switch.

It is still another object of this invention to provide a reliable electronic component with a push switch.

A first aspect of this invention provides a rotatively-operated electronic component with a push switch which comprises a rotatable operation knob: a rotary contact plate connected to the operation knob for motion together with the operation knob; an attachment base plate; resilient contact arms provided on the attachment base plate and contacting the rotary contact plate, the resilient contact arms and the contact plate cooperating to generate at least one electric signal in response to rotation of the operation knob: a drive member connected to the attachment base plate and rotatably supporting the rotary contact plate, the drive member being swingable relative to the attachment base plate; means for allowing the drive member to swing relative to the attachment base plate by application of a force to the operation knob; a push switch portion supported on the attachment base plate; and means for actuating the push switch portion in response to the swing of the drive member relative to the attachment base plate by the application of the force to the operation knob.

A second aspect of this invention is based on the first aspect thereof, and provides a rotatively-operated electronic component with a push switch which further comprises means for providing a resistance to rotation of the operation knob, the resistance-providing means including an uneven surface of the rotary contact plate, and a projection being provided to the drive member and being in contact with the uneven surface of the rotary contact plate, wherein the generated electric signal is in an off state when the projection is in one of recesses in the uneven surface of the rotary contact plate.

A third aspect of this invention is based on the first aspect thereof, and provides a rotatively-operated electronic component with a push switch wherein points of contact among the resilient contact arms and the rotary contact plate substantially exist on a line connecting a center of the rotary contact plate and a center of the swing of the drive member, and one of the resilient contact arms provides a common contact located at an inner part of the rotary contact plate.

A fourth aspect of this invention is based on the first aspect thereof, and provides a rotatively-operated electronic component with a push switch wherein points of contact among the resilient contact arms and the rotary contact plate substantially exist on a first line connecting a center of the rotary contact plate and a center of the push switch portion, and a center of the swing of the drive member substantially exists on a second line perpendicularly intersecting with the first line in a range containing the points of contact among the resilient contact arms and the rotary contact plate.

A fifth aspect of this invention provides a composite device comprising a base member: an electronic component including a rotatable operation knob and being operated in response to rotation of the operation knob: means for supporting the electronic component on the base member: means for allowing the electronic component to swing relative to the base member in response to application of a force to the operation knob; a push switch including an operation button engageable with a part of the electronic component; means for supporting the push switch on the base member; and means for enabling the part of the electronic component to actuate the operation button of the push switch in response to swing of the electronic component relative to the base member by the application of the force to the operation knob.

A sixth aspect of this invention provides a composite device comprising a base member; an electronic component including a rotatable operation knob and being operated in response to rotation of the operation knob; means for supporting the electronic component on the base member; means for allowing the electronic component to swing relative to the base member in response to application of a force to the operation knob; a push switch including an operation button; means for supporting the push switch on the base member; and means for actuating the operation button of the push switch in response to swing of the electronic component relative to the base member by the application of the force to the operation knob.

DESCRIPTION OF THE PREFERRED EMBODIMENTS

First Embodiment

Regarding a first embodiment of this invention, a rotary encoder with a push switch will be described as an example of a rotatively-operated electronic component with a push switch. The rotary encoder in the first embodiment is an incremental encoder of a two-phase output type.

Figure 1:
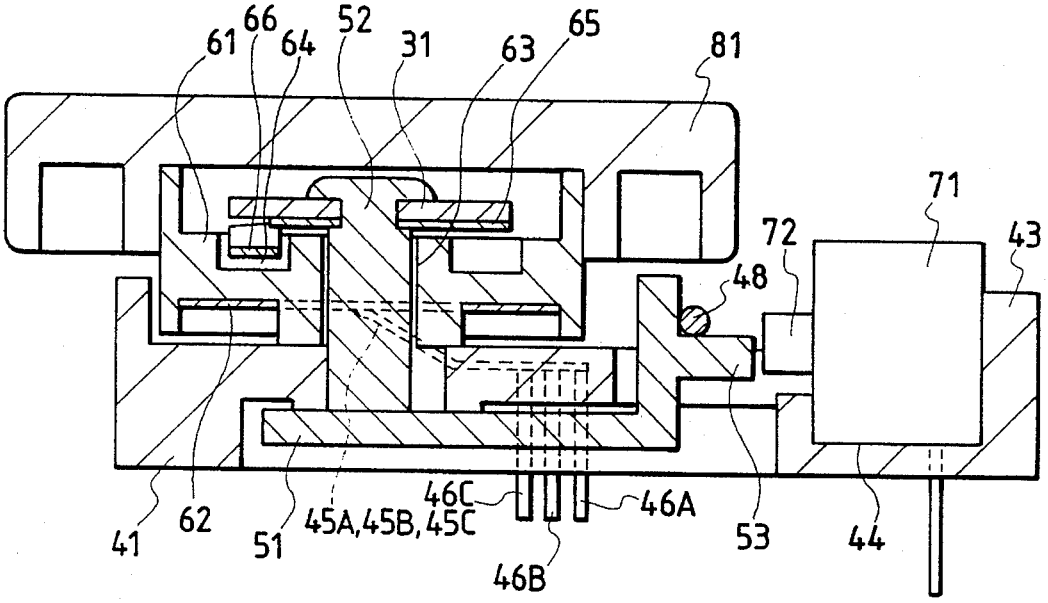
FIG. 1 is a first sectional view of a rotary encoder with a push switch according to a first embodiment of this invention.
Figure 2:
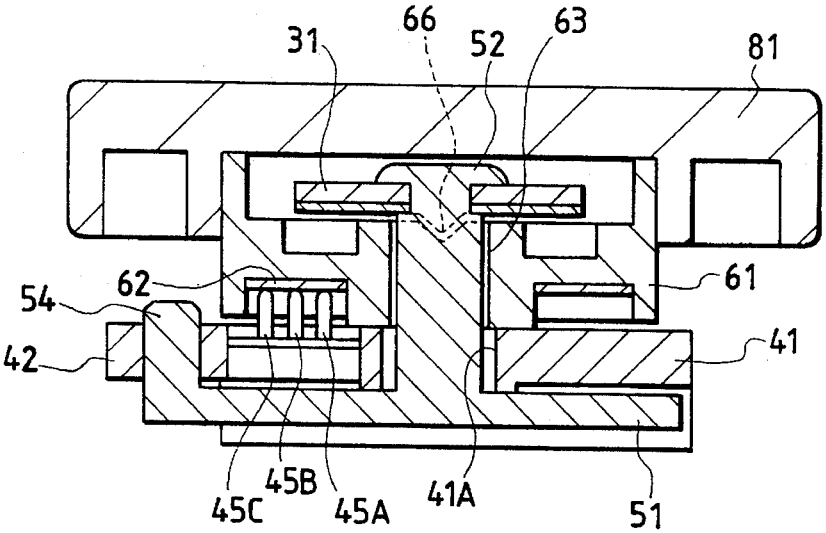
FIG. 2 is a second sectional view of the rotary encoder with the push switch in FIG. 1.

With reference to FIGS. 1 and 2, the rotary encoder with the push switch includes an attachment base plate 41 on which a drive member 51 is movably supported. The drive member 51 can swing relative to the attachment base plate 41 in a given angular range about an axis (a cylindrical shaft 54) perpendicular to the attachment base plate 41. The drive member 51 has an upwardly-projecting cylindrical shaft 52 around which a rotary member 61 is rotatably provided. The rotary member 61 is supported by the cylindrical shaft 52 of the drive member 51. The rotary member 61 has approximately a disk shape or a cylindrical shape. A push switch portion 71 is provided on a rear part of the attachment base plate 41. The push switch portion 71 has a body (a casing) fixed to the attachment base plate 41.

Figure 3:
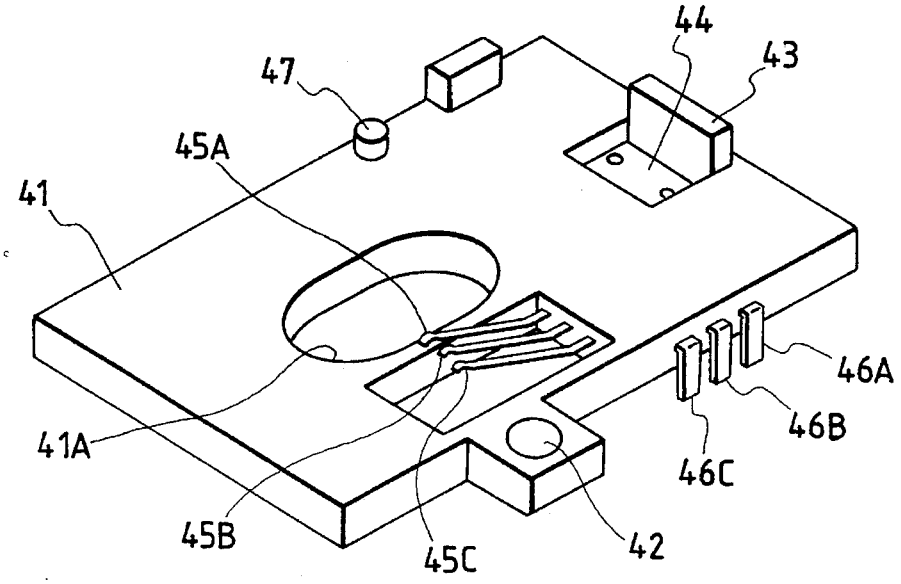
FIG. 3 is a perspective view of an attachment base plate in the rotary encoder with the push switch in FIG. 1.

With reference to FIG. 3, the attachment base plate 41 includes a molded resin member of approximately a flat plate shape which is formed with an oval or arcuate opening 41A, a circular hole 42, and a recess 44. In addition, the attachment base plate 41 is provided with three resilient contact arms (three elastic contact arms) 45A, 45B, and 45C, and connection terminals 46A, 46B, and 46C. The resilient contact arms 45A, 45B, and 45C constitute parts of a rotary encoder.

The cylindrical shaft 52 of the drive member 51 extends through the oval opening 41A in the attachment base plate 41. The oval opening 41A is designed to allow a swing of the drive member 51 in a given angular range. The circular hole 42 is located at an edge of the attachment base plate 41. As will be described later, the circular hole 42 is used for supporting the drive member 51 while allowing the swing thereof. A stop wall 43 fixedly extends on the attachment base plate 1 along a rear edge of the recess 44. The stop wall 43 and the recess 44 serve to hold or fix the body of the push switch portion 71. The resilient contact arms 45A, 45B, and 45C remain in contact with a contact plate 62 fixed to a lower surface of the rotary member 61. The contact plate 62 constitutes a part of the rotary encoder. The resilient contact arms 45A, 45B, and 45C and the contact plate 62 serve to generate electric signals. The resilient contact arms 45A, 45B, and 45C electrically lead to the connection terminals 46A, 46B, and 46C respectively (see FIG. 5). The generated electric signals can be outputted to exterior via the connection terminals 46A, 46B, and 46C.

As shown in FIG. 2, an edge part of the drive member 51 has an upwardly-projecting cylindrical shaft 54 which extends through the circular hole 42 in the attachment base plate 41. The cylindrical shaft 54 of the drive member 51 fits in the circular hole 43 in the attachment base plate 41 so that the drive member 51 is supported on the attachment base plate 41. Further, the drive member 51 can swing about the circular shaft 54 in the given angular range.

The lower surface of the rotary member 61 is provided with the contact plate 62 which touches the resilient contact arms 45A, 45B, and 45C on the attachment base plate 41. The contact plate 62 is circular, being coaxial with the rotary member 61. The contact plate 62 rotates together with the rotary member 61. A center of the rotary member 61 has a circular hole 63 through which the cylindrical shaft 52 of the drive member 51 extends. The rotary member 61 fits around the cylindrical shaft 52 of the drive member 51 so that the rotary member 61 is rotatably supported on the cylindrical shaft 52 of the drive member 51. A disk-shaped or cylinder-shaped operation knob 81 is fitted around and fixed to an upper half of the rotary member 61 by, for example, a pressing process. The operation knob 81 rotates together with the rotary member 61. A leaf spring 65 and a washer 31 are fixed to an upper end of the cylindrical shaft 52 of the drive member 51 by pressing and deforming a part of the walls of the cylindrical shaft 52. The washer 31 prevents separation of the rotary member 61 from the cylindrical shaft 52 of the drive member 51.

Figure 4:
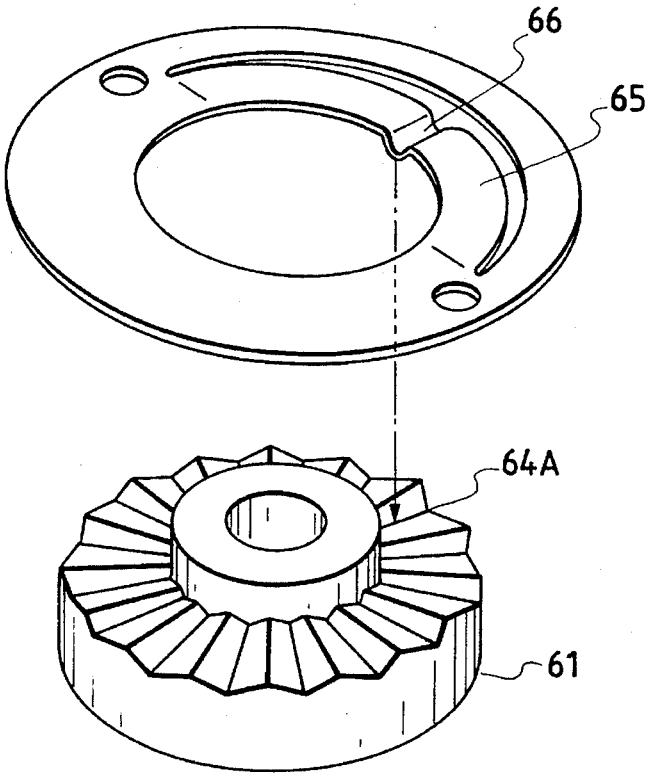
FIG. 4 is a perspective exploded view of a rotary member and a leaf spring in the rotary encoder with the push switch in FIG. 1.

As shown in FIGS. 1 and 4, the rotary member 61 has an uneven upper surface formed with projections and recesses 64A extending radially and alternately. The projections have an inverted-V-shaped cross section while the recesses 64A have a V-shaped cross section. The leaf spring 65 has a downward projection 66 pressed against the uneven upper surface of the rotary member 61. During rotation of the operation knob 81, that is, during rotation of the rotary member 61, the downward projection 66 on the leaf spring 65 relatively rotates and slides on the upper surface of the rotary member 61 while following the unevenness in the upper surface of the rotary member 61. In this case, the contact between the downward projection 66 on the leaf spring 65 and the uneven upper surface of the rotary member 61 provides a suitable resistance to the rotation of the rotary member 61, that is, the rotation of the operation knob 81. Normally, the downward projection 66 on the leaf spring 65 is in the bottom of one of the recesses 64A in the upper surface of the rotary member 61.

Figure 5:
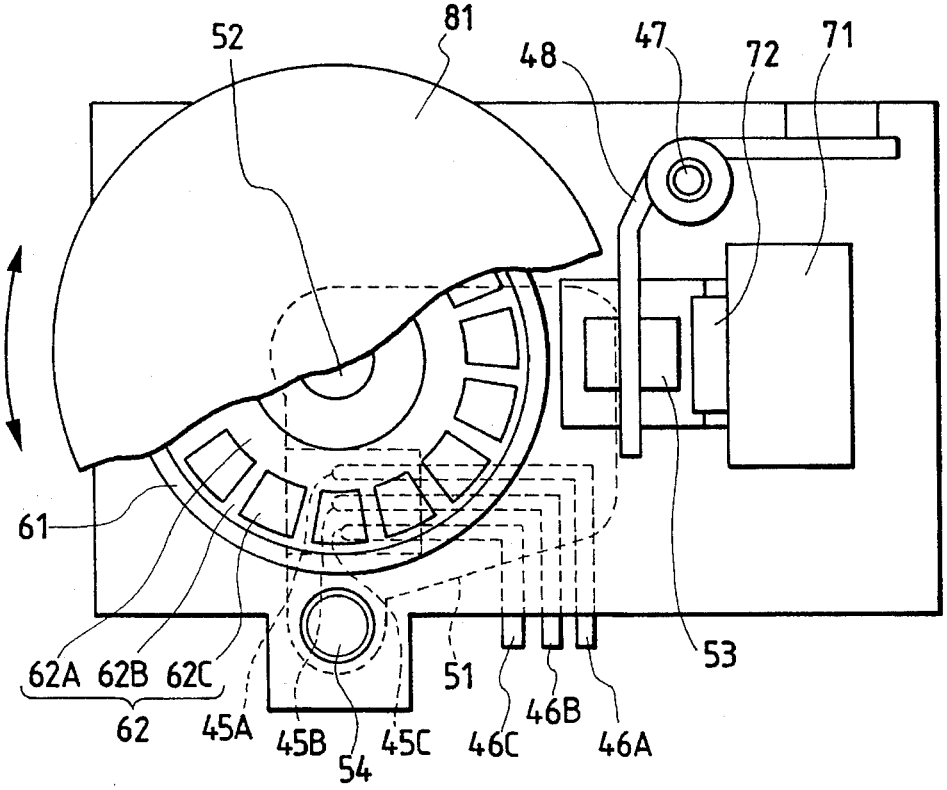
FIG. 5 is a first top view, with a portion broken away, of the rotary encoder with the push switch in FIG. 1.

The resilient contact arms 45A, 45B, and 45C are pressed against the contact plate 62 by their elasticities. As shown in FIG. 5, the contact plate 62 has an inner ring contact 62A and linear contacts 62B. The linear contacts 62B extend radially outward from the inner ring contact 62A. Accordingly, the inner ring contact 62A and the linear contacts 62B are electrically connected to each other. The linear contacts 62B are spaced along a circumferential direction of the contact plate 62 by equal angular intervals. The linear contacts 62B are circumferentially separated from each other by insulating zones 62C. The angular dimension of each insulating zone 62C is preferably equal to several times the angular dimension of each linear contact 62B. During rotation of the operation knob 81, the resilient contact arm 45A remains in touch with the inner ring contact 62A. Accordingly, the resilient contact arm 45A serves as a common contact. During rotation of the operation knob 81, the resilient contact arm 45B sequentially and alternately meets the linear contacts 62B and the insulating zones 62C so that a first electric pulse signal can be generated between the resilient contact arm 45B and the resilient contact arm (the common contact) 45A. In addition, the resilient contact arm 45C sequentially and alternately meets the linear contacts 62B and the insulating zones 62C so that a second electric pulse signal can be generated between the resilient contact arm 45C and the resilient contact arm (the common contact) 45A. The point of contact between the resilient contact arm 45B and the contact plate 62 angularly disagrees with the point of contact between the resilient contact arm 45C and the contact plate 62 by a given small interval. Therefore, the phases of the first and second electric signals slightly differ from each other.

The point of contact between the resilient contact arm 45A and the contact plate 62, the point of contact between the resilient contact arm 45B and the contact plate 62, and the point of contact between the resilient contact arm 45C and the contact plate 62 approximately align with each other along the line connecting the center of the contact plate 62 and the center of the circular hole 42 in the attachment base plate 41. It should be noted that the drive member 51 can swing about the center of the circular hole 42 in the attachment base plate 41.

When the downward projection 66 on the leaf spring 85 is in the bottom of one of the recesses 64A in the upper surface of the rotary member 61, the resilient contact arms 45B and 45C are in touch with one of the insulating zones 62C of the contact plate 62 so that the previously-indicated first and second electric signals are in off states.

The attachment base plate 41 has a pin-shaped upward projection 47 which supports a torsion coil spring 48. The torsion coil spring 48 urges a side surface of the drive member 51 in a direction parallel to the attachment base plate 41 and away from the push switch portion 71. The torsion coil spring 48 may urge a side surface of the rotary member 61 rather than the side surface of the drive member 51.

As shown in FIG. 1, the push switch portion 71 fits into the recess 44 in the attachment base plate 41. A rear end of the push switch portion 71 contacts the stop wall 43. Thereby, the body (the casing) of the push switch portion 71 is fixed to the attachment base plate 41. The push switch portion 71 has an operation button 72 which faces a projection 53 on the drive member 51. The operation button 72 of the push switch portion 71 remains in contact with the projection 53 on the drive member 51. Alternatively, the operation button 72 of the push switch portion 71 may be spaced from the projection 53 on the drive member 51 by a given interval when the drive member 51 is in its normal position. In this case, the projection 53 on the drive member 51 encounters the operation button 72 of the push switch portion 71 as the drive member 51 swings from its normal position.

As previously described, the drive member 51 can swing relative to the attachment base plate 41 about the circular shaft 54 in the given angular range. The resilient contact arm 45A on the attachment base plate 41 remains in touch with the inner ring contact 62A of the plate 62 independent of the swing of the drive member 51 in the given angular range. Further, the resilient contact arms 45B and 45C remain in a radial range corresponding to the radial dimensions of the linear contacts 62B and the insulating zones 62C independent of the swing of the drive member 51 in the given angular range.

Hereinafter, a description will be given of operation of the rotary encoder with the push switch. With reference to FIG. 5, the operation knob 81 can be rotated together with the rotary member 61 about the cylindrical shaft 52 of the drive member 51 by an applied force along a tangential direction denoted by the arrows. During rotation of the operation knob 81, that is, during rotation of the rotary member 61, the resilient contact arms 45A, 45B, and 45C on the attachment base plate 41 relatively rotate and slide on the contact plate 62 at the lower surface of the rotary member 61. In this case, the resilient contact arm 45A remains in touch with the inner ring contact 62A of the plate 62 while the resilient contact arms 45B and 45C sequentially and alternately meet the linear contacts 62B and the insulating zones 62C of the plate 62. Therefore, first and second electric pulse signals can be generated among the resilient contact arms 45A, 45B, and 45C. The first and second generated electric signals travel from the resilient contact arms 45A, 45B, and 45C to the connection terminals 46A, 46B, and 46C before being outputted to an exterior via the connection terminals 46A, 46B, and 46C.

Figure 6:
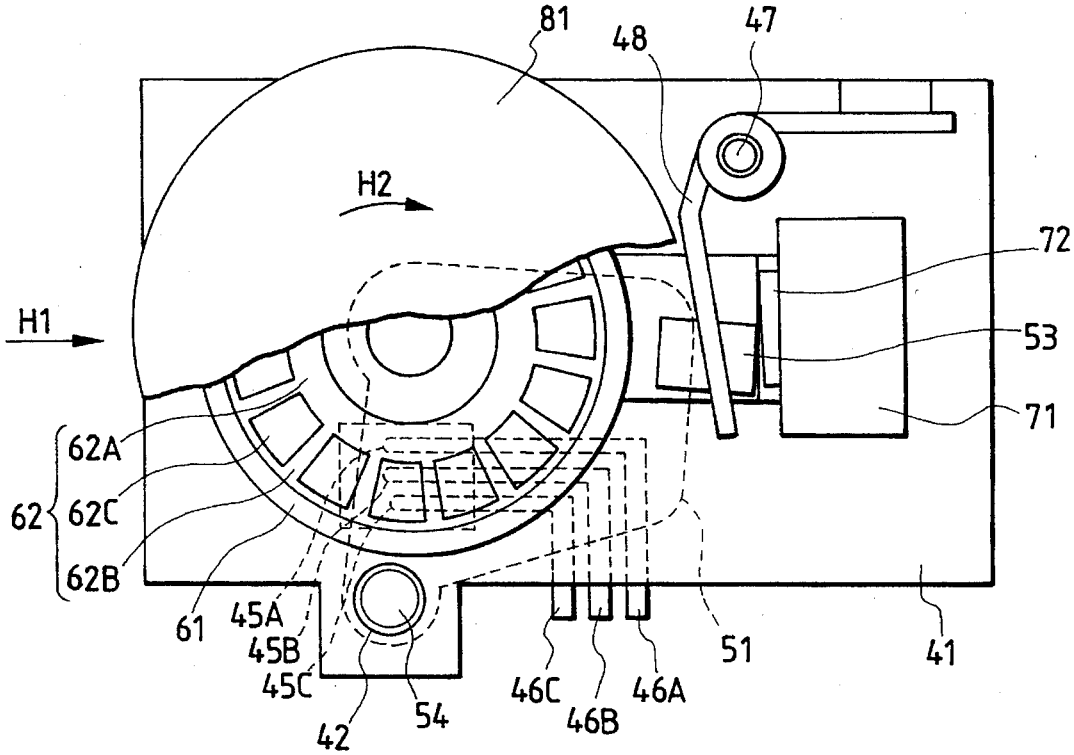
FIG. 6 is a second top view, with a portion broken away, of the rotary encoder with the push switch in FIG. 1.

With reference to FIG. 6, in the case where the operation knob 81 is subjected to a force along a direction Hi parallel to the attachment base plate 41 and toward the push switch portion 71 (that is, a direction of the line connecting the center of the operation knob 81 and the center of the push switch portion 71), the operation knob 81 and the drive member 51 can be swung about the cylindrical shaft 54 of the drive member 51 in a direction H2 against the force of the torsion coil spring 48 on the attachment base plate 41. As the drive member 51 swings about the cylindrical shaft 54 in the direction H2, the projection 53 on the drive member 51 actuates the operation button 72 of the push switch portion 71. An electric signal can be generated in response to the actuation of the operation button 72 of the push switch portion 71. The generated electric signal is transmitted from the push switch portion 71 to an exterior. When the force is removed from the operation knob 81, the drive member 51 and the operation knob 81 are returned to their normal positions (see FIG. 5) by the force of the torsion coil spring 48 on the attachment base plate 47. In this case, the operation button 72 of the push switch portion 71 returns to its normal position.

It should be noted that the rotary encoder may be replaced by another rotatively-operated electronic component such as a rotary variable resistor.

The rotary encoder with the push switch has advantages as follows. The rotary encoder is operated by accessing the operation knob 81. Also, the push switch portion 71 is operated by accessing the operation knob 81. Accordingly, the operation button 72 of the push switch portion 71 can be small. This enables a small size of the rotary encoder with the push switch. As previously described, the rotary encoder and the push switch portion 71 are operated by actuating only the operation knob 81. Thus, the rotary encoder with the push switch can be easily and quickly operated. The rotary encoder and the push switch portion 71 are provided in common on the attachment base plate 41. Therefore, the rotary encoder with the push switch can be handled as a single unit or a single electronic component. Furthermore, the positional relation between the rotary encoder and the push switch portion 71 can be accurately maintained. In addition, the rotary encoder with the push switch can be easily attached to an electronic device.

Second Embodiment

Figure 7:
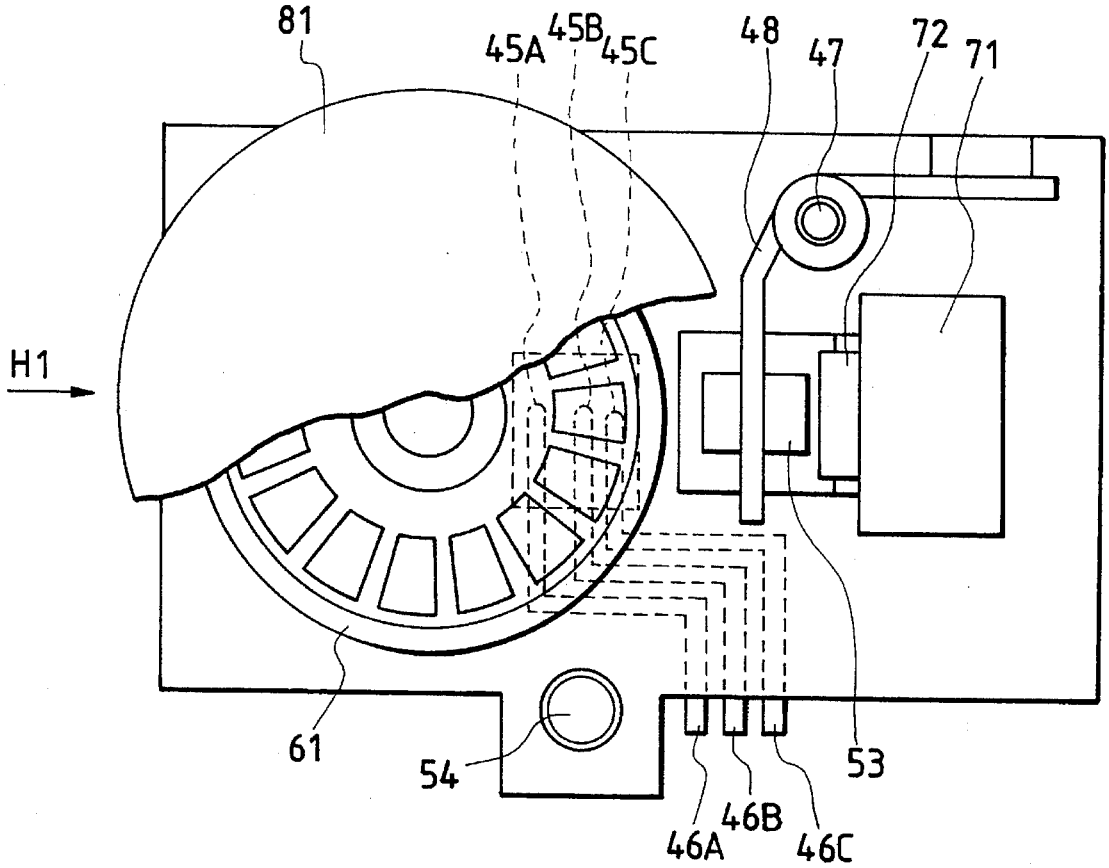
FIG. 7 is a top view, with a portion broken away, of a rotary encoder with a push switch according to a second embodiment of this invention.

FIG. 7 shows a second embodiment of this invention which is similar to the embodiment of FIGS. 1–6 except for design changes indicated hereinafter.

In the embodiment of FIG. 7, the point of contact between a resilient contact arm 45A and a contact plate 62, the point of contact between a resilient contact arm 45B and the contact plate 62, and the point of contact between a resilient contact arm 45C and the contact plate 62 approximately exist on the line connecting the center of the contact plate 62 and the center of a push switch portion 72. The center of a circular shaft 54, about which a drive member 51 (see FIGS. 1 and 2) can swing, exists on a line perpendicularly intersecting with the line connecting the center of the contact plate 62 and the center of the push switch portion 72 in a region containing the points of contact among the resilient contact arms 45A, 45B, and 45C and the contact plate 62.

As an operation knob 81 is pressed in a direction H1 and hence a rotary member 61 with the contact plate 62 is swung about the cylindrical shaft 54, the points of contact among the resilient contact arms 45A, 45B, and 45C and the contact plate 62 move mainly along a radial direction with respect to the contact plate 62. A radial dimension of an inner ring contact 62A (see FIGS. 5 and 6) of the plate 62 is chosen so that the resilient contact arm 45A will remain in touch with the inner ring contact 62A of the plate 62 independent of the swing of the drive member 51. Further, radial dimensions of linear contacts 62B and insulating zones 62C (see FIGS. 5 and 6) of the plate 62 are chosen so that the resilient contact arms 45B and 45C will remain in a radial range corresponding thereto independent of the swing of the drive member 51.

What is claimed is:

1. A rotatively-operated electronic component with a push switch, comprising:

a rotatable operation knob;

a rotary contact plate connected to the operation knob for motion about a first axis together with the operation knob;

an attachment base plate;

resilient contact arms provided on the attachment base plate and contacting the rotary contact plate, the resilient contact arms and the contact plate cooperating to generate at least one electric signal in response to rotation of the operation knob;

a drive member connected to the attachment base plate and rotatably supporting the rotary contact plate, the drive member being swingable relative to the attachment base plate about a second axis;

means for allowing the drive member to swing relative to the attachment base plate about said second axis by application of a force to the operation knob;

a push switch portion supported on the attachment base plate; and means for actuating the push switch portion in response to swing of the drive member relative to the attachment base plate by the application of the force to the operation knob.

2. A rotatively-operated electronic component with a push switch as recited in claim 1, further comprising means for providing resistance to rotation of the operation knob, the resistance-providing means including an uneven surface of the rotary contact plate, and a projection being provided to the drive member and being in contact with the uneven surface of the rotary contact plate, wherein the generated electric signal is in an off state when the projection is in a recess in the uneven surface of the rotary contact plate.

3. A rotatively-operated electronic component with a push switch as recited in claim 1, wherein points of contact among the resilient contact arms and the rotary contact plate substantially exist on a line connecting a center of the rotary contact plate and a center of rotation of the drive member, and one of the resilient contact arms provides a common contact located at an inner part of the rotary contact plate.

4. A rotatively-operated electronic component with a push switch as recited in claim 1, wherein points of contact among the resilient contact arms and the rotary contact plate substantially exist on a first line connecting a center of the rotary contact plate and a center of the push switch portion, and a center of rotation of the drive member substantially exists on a second line perpendicularly intersecting with a first line in a range containing the points of contact among the resilient contact arms and the rotary contact plate.

5. A composite device comprising:

a base member;

an electronic component including a rotatable operation knob operated in response to rotation of the operation knob to rotate about a first axis;

means for supporting the electronic component on the base member;

means for allowing the electronic component to swing relative to the base member about a second axis in response to application of a force to the operation knob; a push switch including an operation button engageable with a part of the electronic component;

means for supporting the push switch on the base member; and means for enabling the electronic component to actuate the operation button of the push switch in response to rotation of the electronic component relative to the base member about the second axis by the application of the force to the operation knob.

6. A composite device comprising:

a base member;

an electronic component including a rotatable operation knob and being operated in response to rotation of the operation knob to rotate about a first axis;

means for supporting the electronic component on the base member;

means for allowing the electronic component to swing relative to the base member about a second axis in response to application of a force to the operation knob;

a push switch including an operation button;

means for supporting the push switch on the base member; and means for actuating the operation button of the push switch in response to swing of the electronic component relative to the base member about said second axis by the application of the force to the operation knob.

* * * * *